United States Patent [19]

Juang

[11] Patent Number: 4,738,225

[45] Date of Patent: Apr. 19, 1988

[54] HEAT TRANSFER APPARATUS FOR WATER HEATER

[76] Inventor: Jinn C. Juang, No. 328, Tung Ning Road, Tainan, Taiwan

[21] Appl. No.: 56,968

[22] Filed: Jun. 3, 1987

[51] Int. Cl.[4] ..... F22B 23/06; F22B 37/48

[52] U.S. Cl. ..... 122/367 C; 122/235 C; 122/235 F; 122/235 K; 165/151; 165/182

[58] Field of Search ..... 122/14, 18, 19, 367 C, 122/235 C, 235 K, 235 F, 264; 165/185, 182, 151

[56] References Cited

U.S. PATENT DOCUMENTS 3,759,050 9/1973 Slaasted et al. ..... 165/151 X 4,501,232 2/1985 Gordbegli et al. ..... 122/367 C

FOREIGN PATENT DOCUMENTS 2144204 2/1985 United Kingdom ..... 122/367 C

*Primary Examiner*—Edward G. Favors

*Attorney, Agent, or Firm*—Morton J. Rosenberg

[57] ABSTRACT

A plurality of rows of circular openings for supporting water tube sections and turbulence fin arrays comprising plural vertically arrayed fin slots for guiding combustion gas to flow upwards at an angle therethrough are provided on each of a plurality of fin plates which are arrayed in parallel and disposed at the upper end of a water heater. The circular openings and the turbulence fin arrays of each row are alternately positioned. Therefore, each circular opening of a lower row is located below either of the turbulence fin arrays of a next higher row and each turbulence fin array of a lower row is located below either of said circular openings of a next higher row.

3 Claims, 5 Drawing Sheets

HEAT TRANSFER APPARATUS FOR WATER HEATER

BACKGROUND OF THE INVENTION

The present invention relates to a water heater, and particularly to an improved heat transfer apparatus designed to increase the efficiency of heat transfer to the water flowing through the water heater.

As shown in FIG. 5, a typical conventional water heater includes a cold water inlet tube section coiled around a combustion chamber shell in which fuel is burned by a gas burner, a plurality of parallel tube sections interconnected by return bends and disposed within parallel fin plates provided at the top of the combustion chamber, and a hot water outlet tube section extending from the fin plates to the bottom side of the combustion chamber shell to discharge hot water. The fin plates absorb heat from the combustion gas flowing upwards parallel to the surface of the fin plates and transfer the heat to the parallel tube sections, primarily by radiation and secondarily by conduction. During combustion, air enters into the combustion chamber from the bottom thereof and the hot combustion gas escapes from the combustion chamber through the fin plates. It is found that a substantial amount of heat energy is lost during the operation of such a water heater. This is because the large space between the parallel tube sections (see FIG. 6) can not hinder the directly upward movement of the hot gas, so a lot of heat not yet being absorbed by the fin plates and the parallel tube sections, together with the quickly escaping gas, is wasted. Moreover, the rapid outgoing movement of the hot gas causes a rapid draft of air into the combustion chamber, which blows and adversely affects the flame produced at the burner. In order to mitigate such a problem, wind shields are provided at the top and bottom of the combustion chamber to partially cover the air inlet and the waste combustion gas outlet. However, these wind shields have introduced disadvantages such as poor air circulation causing incomplete combustion of the fuel, an inhibited the discharge of the waste gas, causing some waste gas and the water vapor present in the waste gas to be confined in the heater. When the heater becomes cold, the waste gas remaining in the heater then produces liquid droplets on the wall of the heater and the fin plates, thereby causing the heater parts to deteriorate within a short period of time.

SUMMARY OF THE INVENTION

A primary objective of the invention is therefore to provide an improved heat transfer apparatus for a water heater, which minimizes heat loss among the outgoing waste gas flowing through the heat transfer apparatus.

Another objective of the invention is to provide an improved heat transfer apparatus for a water heater, which obviates and/or mitigates the drawbacks of the prior art.

A further objective of the invention is to provide an improved heat transfer apparatus that permits split flows of water through the heated fin plates so that there is a greater heat transfer area which absorbs heat more efficiently than in a conventional water heater.

Still another objective of the invention is to provide an improved heat transfer apparatus for a water heater, wherein a plurality of turbulence fin arrays, each comprising plural vertically arrayed and evenly spaced fin slots, are provided on each of the parallel fin plates so as to produce a turbulent path for combustion gas to flow out of the heater.

A further objective of the invention is to provide an improved heat transfer apparatus for a water heater, wherein the parallel tube sections of plural rows are arranged so that each of tube sections of a lower row are located below a space between two adjacent tube sections of next higher row so as to block the path through which combustion gas can vertically flow upwards.

An exemplary preferred embodiment will be described in detail with reference to the following drawings.

DETAILED DESCRIPTION OF THE PREFERRED EMBODIMENT

Figure 1:
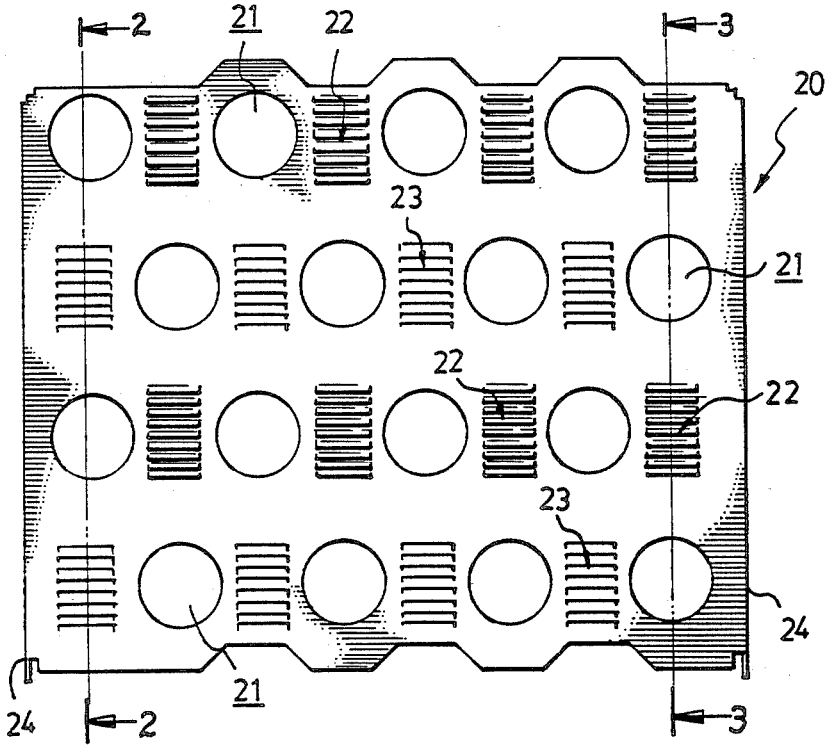
FIG. 1 is a front view of a fin plate according to the present invention.

Referring to FIG. 1 to 4, the heat transfer apparatus for a water heater according to the present invention, generally designated by the reference numeral 10, comprises a plurality of fin plates 20 and a water tube assembly 30 passing through the fin plates 20. The water tube assembly 30 comprises a cold water inlet section 31, a hot water outlet section 32 and a plurality of parallel tube sections 33 connecting, to the inlet and outlet sections 31 and 32 with both ends thereof. The heat transfer apparatus 10 is mounted at the top of a water heater so as to absorb heat from the flame therebelow and the upward-flowing combustion gas.

A plurality of fin plates 20 are disposed in parallel and evenly spaced at an open top end of the combustion chamber housing (not shown) to absorb heat produced by the gas burner and transfer heat to the tube sections primarily by radiation. Each fin plate 20 is provided with four rows of circular openings 21, which are spaced one row above the other row, for supporting and positioning the parallel tube sections 33. Each fin plate 20 is provided with two opposite end rims 24 such that two opposite end walls are formed with continuous end rims 24 as a plurality of fin plates 20 are closely arrayed together. A plurality of thin substantially rectangular spaces 28 are thus formed and each is between two adjacent fin plates 20. Combustion gas flows upwards through the parallel spaces 28 between fin plates 20, and then heat is absorbed by the fin plates 20 and the tube sections 33 across the fin plates 20. The topmost first row includes an even number of circular openings, for example, four circular openings 21 aligned horizontally and evenly spaced from each other so as to position four tube sections 33 passing therethrough. The second row includes another four circular openings 21 aligned horizontally and evenly spaced from each other for positioning another four tube sections 33. Every opening 21 of the second row is located below a position either between two adjacent openings 21 of the first row or between an opening 21 of the first row and an end rim 24 of the fin plate. Then, the four tube sections 33 of the second row (supported by the second row of circular openings 21) block combustion gas from flowing directly upward to pass through the spaces between the four tube sections 33 of the first row (supported by the first row of circular openings 21). The third row also includes four horizontal and evenly spaced circular openings 21, each of which vertically aligns a circular opening 21 of the first row. Accordingly, the four tube sections 33 of the third row are located below those of the first row and block combustion gas from flowing directly and upwards to pass through the spaces between the four tube sections 33 of the second row. The fourth row also includes four evenly spaced circular openings 21, each of which vertically aligns a circular opening 21 of the second row. Similarly, the four tube sections 33 of the fourth row are located below those of the second row and meanwhile block combustion gas from flowing directly and upwards to pass through the spaces between the four tube sections 33 of the third row. The parallel tube sections 33 are arranged in four rows and spaced one above the other as described hereinbefore.

Figure 4:
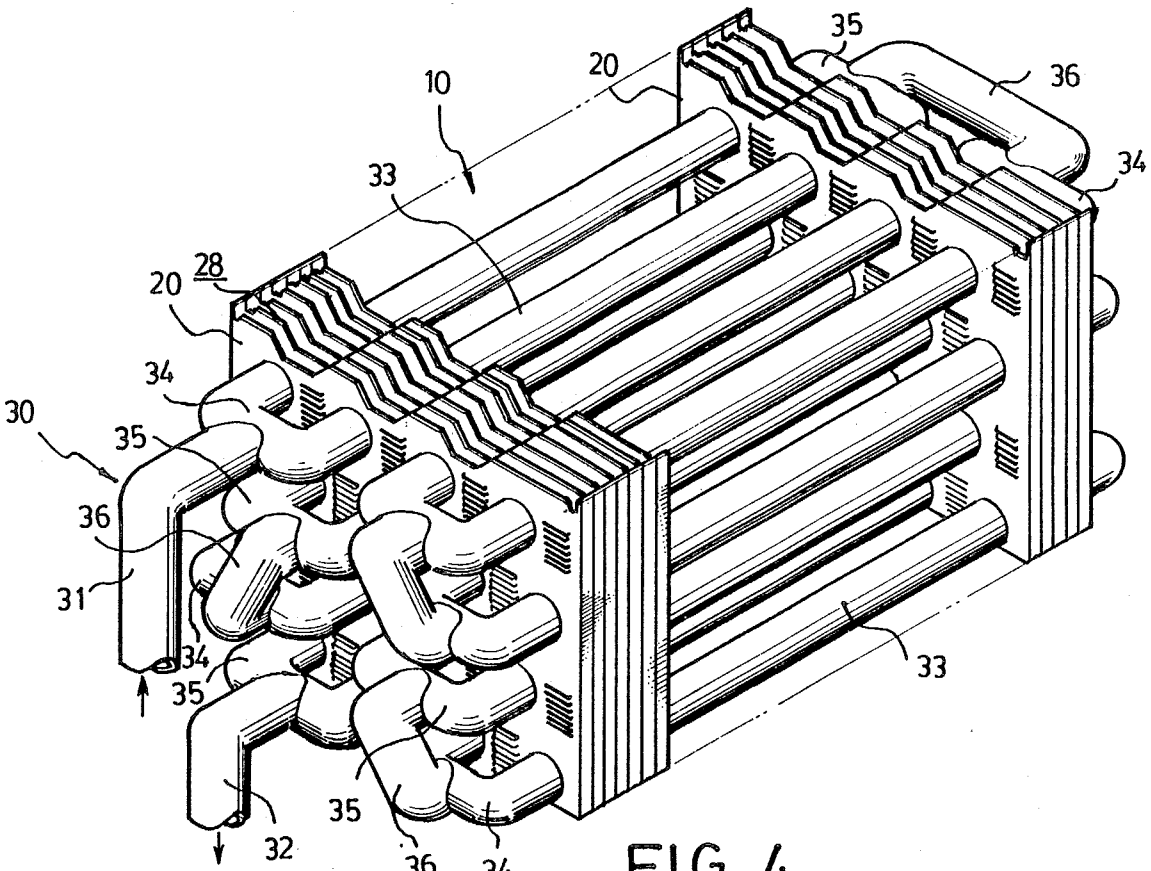
FIG. 4 is a fragmentary perspective view of the heat transfer apparatus according to the present invention.
Figure 5:
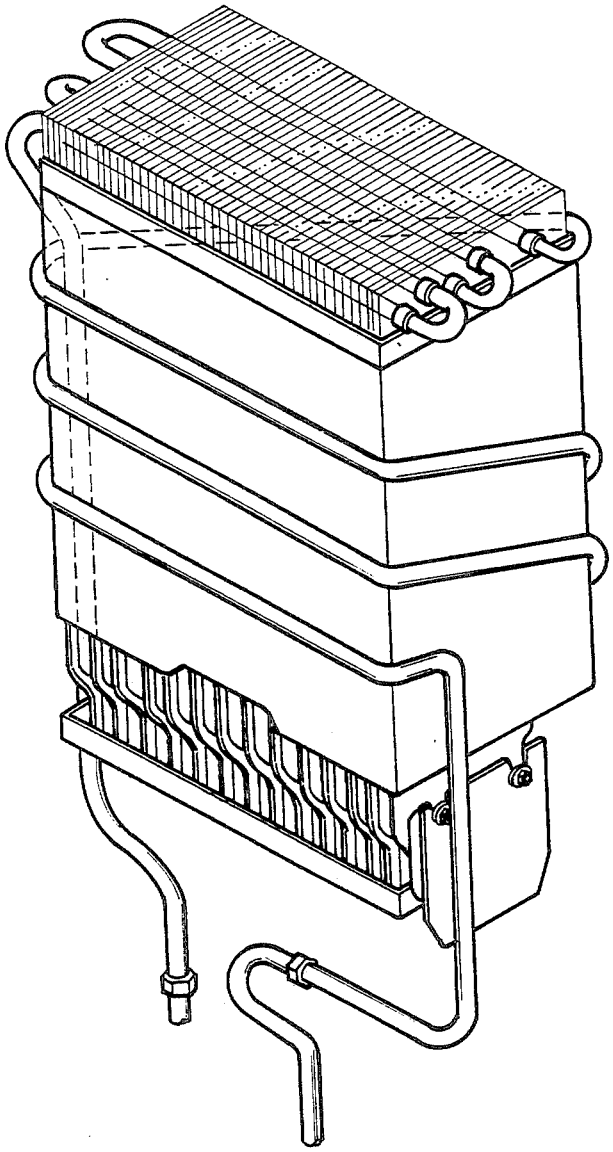
PRIOR ART FIG. 5
FIG. 5 is a perspective view of a conventional water heater with the heater housing removed.
Figure 6:
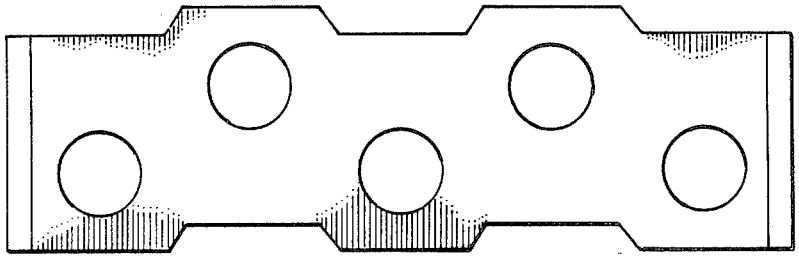
PRIOR ART FIG. 6
FIG. 6 is a front view of a fin plate of the water heater shown in FIG. 5.

The parallel tube sections on each row are divided into two parts, further half of the parallel tube sections on both sides are interconnected by a flow-splitting bend 34 and a flow-merging bend 35 at their ends. The flow-splitting bends 34 and the flow-merging bends 35 are connected to the respective pair of tube sections 33 in this embodiment with four circular openings in each row and may be arranged in any appropriate fashions. The arrangement of pairing tube sections 33 as shown in FIG. 4 is a preferred embodiment and only for illustrative purposes. There are further provided bends 36 connecting each of the flow-merging bends 35 to an adjacent flow-splitting bend 34, thereby forming a water flow path that splits the water flow when water passes through the fin plates 20. The bends 36 are connected, such as by welding, to the intermediate portions of the flow-splitting and flow-merging bends 34 and 35. For the same amount of water, the split-flow tube arrangement provides greater heat transfer area within the fin plates 20 than the conventional nonsplit flow tube arrangement, substantially twice the heat transfer area of the conventional nonsplit flow tube arrangement with a fin plate of the same area. This results in an increase in the heat transfer efficiency of the water heater. In order to improve the heat confining effect in the heat transfer area located at the top of the combustion chamber shell, the interval between two adjacent tube sections 33 is arranged to be approximately equal to the diameter of each tube section 33. Therefore, the interval between two adjacent circular openings 21, supporting tube sections with slightly smaller diameter, is arranged to be approximately equal to the diameter of each circular opening 21. As the rate of the outgoing combustion gas is thus slowed by alternately arraying the tube sections as described hereinbefore, the rate of the drawing air into the combustion chamber shell is also slowed, thereby minimizing air drafts.

In order to further improve the heat transfer efficiency between the upward combustion gas and the fin plates 20, a turbulent upward flow of combustion gas passing through the separated laminar spaces between parallel fin plates 20, other than presently conventional laminar flow, can achieve the objective. Each fin plate 20 is provided with four rows of turbulence fin arrays 22 and 23 and each row of the turbulence fin arrays 22 or 23 comprises four fin arrays 22. In same row of the fin array 22 or 23 and circular openings 21, each of the turbulence fin arrays 22 or 23 is provided either between two adjacent circular openings 21 or between an opening 21 and its adjacent end rim 24 of the fin plate 20. This means that the circular openings and the turbulence fin arrays are alternately arranged horizontally and vertically. Each of the turbulence fin arrays 22 or 23 on all four rows comprises a plurality of vertically arrayed and evenly spaced turbulence fins. Each fin array 22 or 23 of a lower row is located below one of the circular openings 21 of it next upper row. In addition, each of the four turbulence fin arrays 22 or 23 of a lower row is located below one of the turbulence fin arrays 22 or 23 of the row of two rows above.

Figure 2:
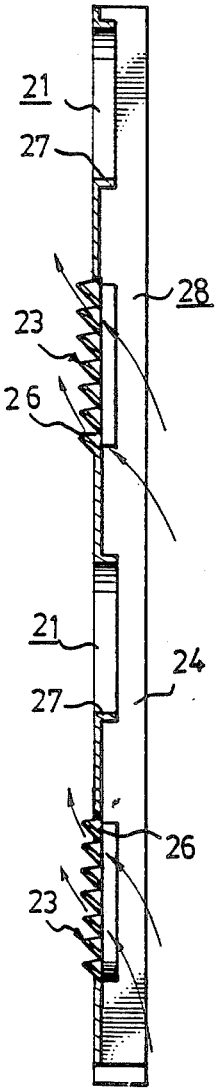
FIG. 2 is a cross-sectional view of the fin plate as taken along the line 2—2 shown in FIG. 1.
Figure 3:
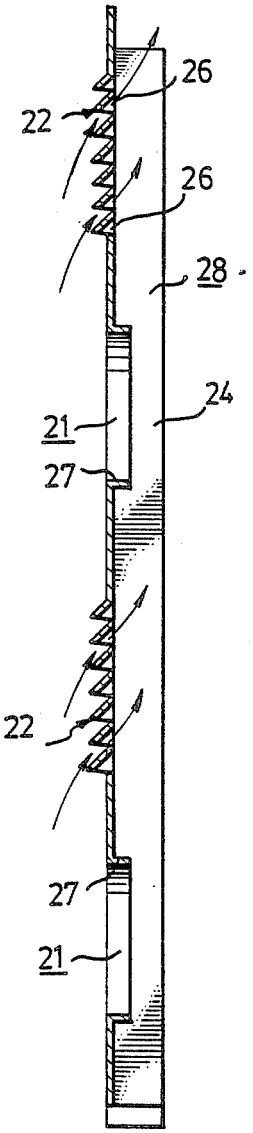
FIG. 3 is a cross-sectional view of the fin plate as taken along the line 3—3 shown in FIG. 1.

Referring to FIG. 2, it can be seen that each turbulence fin array 22 of the first and third rows comprises a plurality of vertically arrayed and evenly spaced fin slots 26 which guide combustion gas to flow upwards at a slight angle therethrough from one side of the fin plate 20 to the other side thereof. As shown in FIG. 2, combustion gas is guided to flow through the fin slots 26 from the front side (the side shown in FIG. 1 is the front side) of the fin plate 20 to the rear side thereof. Referring to FIG. 3, each turbulence fin array 23 of the second and fourth rows comprises a plurality of vertically arrayed and evenly spaced fin slots 26 which guide combustion gas to flow upwards therethrough from the rear side of the fin plate 20 to the front side thereof. Also, as can be seen in FIG. 2 and 3, each of the opposite end rims 24 has an appropriate width (forming the width of the laminar space between two adjacent fin plates 20), and each of the circular openings 21 comprises a circular rim 27 with an appropriate depth for supporting the water tube section 33 thereon. It is noted that the depth of the circular rim 27 is smaller than width of the end rims 24 of the fin plate 20.

Because of the arrangement of the turbulent fin arrays 22 and 23 on the parallel and closely arrayed fin plates 20, the upward flow of the combustion gas through the laminar spaces 28 between fin plates 20 becomes turbulent. The heat transferred to the fin plates 20 thus increases and the heat energy loss, in a form of escaping hot combustion gas, decreases.

While the heat transfer apparatus of the preferred embodiment, as shown and described hereinbefore, includes four rows of tube sections 33 and four tube sections 33 in each row, the invention is not limited thereto. It is possible to provide more or less than four rows of tube sections 33, and more than four tube sections 33 in each row according to the present invention. Similarly, the number of rows of circular openings 21 and turbulence fin arrays 22 or 23, and the number of the circular openings 21 and turbulence fin arrays 22 or 23 in each row are in accordance with the arrangement of tube sections 33.

It is noteworthy that the best heat transfer efficiency in the heat transfer apparatus of the water heater according to the invention will be achieved as the combination of the turbulence-producing fin plates 20, alternately positioned multi-arrayed water tube sections 33, and split flow tube arrangement as described hereinbefore are together adopted.

With the invention thus explained, it is apparent that various modifications and variations can be made without departing from the scope of the invention. It is therefore intended that the invention be limited as indicated in the appended claims.

I claim:

1. In a heat transfer apparatus for a water heating having a combustion chamber shell surrounding a gas burner, a plurality of parallel fin plates disposed at an open top end of the combustion chamber shell, and a water tube assembly comprising an inlet tube section, an outlet tube section, and a plurality of parallel tube sections connecting to said inlet and outlet tube sections;

the improvement comprising:

a plurality of circular openings being provided in rows on each said fin plate, and being aligned horizontally and evenly spaced apart from each other for supporting and positioning said parallel tube sections; an even number of said circular openings being provided in each said row thereof, which are spaced one row above another row;

an equal number of turbulence fin arrays as that of said circular openings being provided in each said row on each said fin plate; said circular openings and said turbulence fin arrays being alternately arrayed horizontally and vertically;

a plurality of vertically arrayed and evenly spaced fin slots being provided on each said turbulence fin array of any row, for guiding combustion gas to flow upwards therethrough from one side of said fin plate to another side thereof while said fin slots of each turbulence array of any adjacent row of said any row are formed so as to guide combustion gas to flow obliquely upwards therethrough from one side of said fin plate to an opposing side thereof;

a plurality of flow-splitting bends and flow-merging bends being provided to interconnect half of said tube sections on the same row which are supported and positioned in said circular openings, and which are divided evenly into two parts.

2. A heat transfer apparatus for a water heater as claimed in claim 1, wherein the number of said rows of circular openings and said turbulence fin arrays and the number of said circular openings in each row are four.

3. A heat transfer apparatus for a water heater as claimed in claim 1, wherein the interval between two said adjacent tube sections is arranged to be approximately equal to the diameter of each tube section.

* * * * *